US008431036B2

(12) United States Patent
Mulligan et al.

(10) Patent No.: US 8,431,036 B2
(45) Date of Patent: Apr. 30, 2013

(54) FIRE FIGHTING FOAMING COMPOSITIONS

(75) Inventors: David John Mulligan, Lancaster (GB); Nigel Frank Joslin, Morecambe (GB)

(73) Assignee: Kidde IP Holdings Limited, Colnbrook Slough (GB)

( * ) Notice: Subject to any disclaimer, the term of this patent is extended or adjusted under 35 U.S.C. 154(b) by 525 days.

(21) Appl. No.: 12/452,423

(22) PCT Filed: Jun. 29, 2007

(86) PCT No.: PCT/GB2007/002464

§ 371 (c)(1),
(2), (4) Date: Jun. 14, 2010

(87) PCT Pub. No.: WO2009/004272

PCT Pub. Date: Jan. 8, 2009

(65) Prior Publication Data

US 2010/0276625 A1 Nov. 4, 2010

(51) Int. Cl.
*A62D 1/02* (2006.01)

(52) U.S. Cl.
USPC ..... 252/3; 252/6.5; 252/8.05

(58) Field of Classification Search ..... 252/3, 6.5, 252/8.05
See application file for complete search history.

(56) References Cited

U.S. PATENT DOCUMENTS

| | | | | |
|---|---|---|---|---|
| 2,361,057 | A | 10/1944 | Ferdinand | |
| 3,676,169 | A | 7/1972 | Degginger | |
| 4,880,618 | A * | 11/1989 | Grollier et al. | 424/43 |

FOREIGN PATENT DOCUMENTS

| | | |
|---|---|---|
| EP | 0524138 | 1/1993 |
| GB | 2311219 | 9/1997 |
| WO | 9605889 | 2/1996 |
| WO | WO02102463 A | 12/2002 |

OTHER PUBLICATIONS

STIC Search Report dated Sep. 14, 2012.*
Poole S: "Review: The Foam-Enhancing Properties of Basic Biopolymers" International Journal of Food Science and Technology, Blackwell Scientific Publications, Oxford, GB, vol. 24, No. 2, 1989, pp. 121-137, XP008014428, ISSN: 0950-5423, p. 131-p. 134.
European Search Report, Jun. 4, 1997, 6 pages.
European Office Action, Jul. 6, 2010, 7 pages.
International Search report of the Patent Cooperation Treaty in counterpart foreign Application No. PCT/GB2007/002464 filed Jun. 29, 2007.

* cited by examiner

*Primary Examiner* — Eisa Elhilo
(74) *Attorney, Agent, or Firm* — MH2 Technology Law Group LLP

(57) ABSTRACT

In a first aspect a fire fighting foaming composition contains a partially acetylated polyvinyl alcohol. In a second aspect the fire fighting foaming composition contains chitosan together with a surfactant such as a protein derived surfactant or a hydrocarbon surfactant which is either amphoteric or non-ionic. The compositions can form effective fire fighting foams in the absence of fluorinated surfactants and other fluorinated compounds.

35 Claims, No Drawings

FIRE FIGHTING FOAMING COMPOSITIONS

The invention relates to fire fighting foaming compositions, fire fighting foams and methods of controlling or extinguishing fires using the foaming compositions.

Fire fighting foaming compositions are commonly used to control or extinguish burning flammable liquids. The foaming composition is normally diluted with water and then aerated to form a foam. The foam is distributed over the burning liquid to form a barrier which extinguishes the fire by excluding oxygen. Hitherto, the most effective foaming compositions contain a fluorine containing surfactant. However, fluorine containing surfactants have a long lifetime in the environment and it is desirable to replace fluorine containing compositions with foaming compositions which are fluorine free or have only a low fluorine content.

In accordance with a first aspect of the invention, there is provided a fire fighting foaming composition or a fire fighting foam comprising: a partially acetylated polyvinyl alcohol comprising units of formula (I) and units of formula (II)

(I)

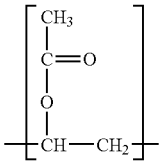

(II)

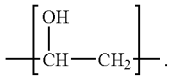

In accordance with a second aspect of the invention, there is provided a fire fighting foaming composition or a fire fighting foam comprising: a linear polysacharide comprising D-glucosamine units and, optionally, N-acetyl-D-glucosamine units; and a surfactant, but excluding the case wherein the surfactant has a hydrocarbon hydrophobic region, an anionic hydrophilic region and no cationic hydrophilic region.

In accordance with a third aspect of the invention, there is provided a fire fighting foaming composition or a fire fighting foam comprising: a poly-D-glucosamine; and a surfactant, but excluding the case wherein the surfactant has a hydrocarbon hydrophobic region, an anionic hydrophilic region and no cationic hydrophilic region.

Preferably, the polysacharide or the poly-D-glucosamine is chitosan or a salt of chitosan, such as chitosan lactate.

The fire fighting foaming compositions of the current invention normally comprise a liquid, which may be, for example, water or water with a water miscible non-aqueous solvent, and one or more components each of which may be in solution or dispersed in the liquid, so that the composition as a whole is generally fluid in nature. In this case, the term fire fighting foaming composition as used herein covers both concentrates which are most effective when diluted down before being aerated to form a foam, and also compositions which are at a suitable concentration to be aerated to form a foam without dilution. However, the fire fighting foaming compositions need not be in the generally fluid form described above. For example, the compositions can be in solid form, such as a powder, which can be dissolved and/or dispersed in a liquid prior to forming a foam.

With regard to the first aspect of the invention, polyvinyl alcohol is commonly manufactured by hydrolysis of polyvinyl acetate. During hydrolysis of polyvinyl acetate the acetylated, units of formula (I).

(I)

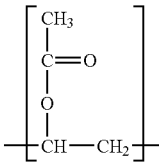

of the polyvinyl acetate are converted to hydroxyl containing units of formula (II)

(II)

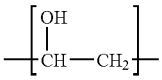

However, hydrolysis does not always go to completion. When hydrolysis is incomplete the resultant polyvinyl alcohol is partially acetylated. That is to say, the partially acetylated polyvinyl alcohol contains both units of formulae (I) and (II).

It has now been found that partially acetylated polyvinyl alcohols containing both units of formulae (I) and (II) are useful foaming agents for fire fighting foaming compositions.

For the present purposes, a partially acetylated polyvinyl alcohol may be made by any suitable method, but is conveniently made by known methods of partial hydrolysis of polyvinyl acetate.

The amount of units of formula (II), that is to say the hydroxyl containing units, as a molar percentage of the combined amount of units of formulae (I) and (H) can vary widely in the partially acetylated polyvinyl alcohols that are suitable for use in the fire fighting foaming compositions. In general, this percentage will be greater that 5% and less than 95%. Preferably, the percentage will be from 71% to 89%. Even more preferably, the percentage will be from 78.5% to 83.5%. Percentages in these preferred ranges equate to maximum surface activity of the partially acetylated polyvinyl alcohol.

Suitable partially acetylated polyvinyl alcohols may also contain other substituents in addition to the units of formulae (I) and (II), so long as the other substituents do not substantially diminish the foaming properties. For example, the hydroxyl group of the unit of formula (II) can be reacted with acrylonitrile to form cyanoethyl ether groups, or reacted with ethylene oxide to form hydroxyethyl groups.

The partially acetylated polyvinyl alcohols used in the fire fighting foaming compositions may have any suitable molecular weight. However, molecular weights from 30,000 to 185,000 are preferred. Even more preferable are molecular weights from 125,000 to 185,000.

Suitable partially acetylated polyvinyl alcohols are commercially available under the trade names Celvol 523™ and Celvol 540™, manufactured by Celanese Chemicals, Gohsenol KP-08™ and Gohsenol KH-20 ™, manufactured by Nippon Goshei, and Mowiol 15-79™, manufactured by Kuraray Specialities Europe.

Effective fire fighting foaming compositions can be formulated using a partially acetylated polyvinyl alcohol as the only foaming agent. However, the addition to the composition of a protein derived surfactant may improve effectiveness of the composition. Suitable protein derived surfactants include those made by alkali hydrolysis of a keratin containing feedstock, such as bovine hoof and horn meal or chicken feathers.

Foaming of the fire fighting foaming composition may be enhanced by the addition of a water miscible non-aqueous solvent such as a glycol or a glycol ether. Examples of suitable solvents include hexylene glycol, butyl carbitol, butyl cellosolve, polyethylene glycol, metyl diproxitol, propylene glycol n-propyl ether and tripropylene glycol methyl ether. Of these hexylene glycol is preferred.

In view of the desirability of reducing the use of fluorine containing compounds, the fire fighting foaming composition preferably does not include any fluorine containing surfactant and more preferably does not contain any fluorine containing compounds at all. Surprisingly, even in the absence of fluorinated surfactants, fire fighting foaming compositions which include at least one partially acetylated polyvinyl alcohol may be used to produce foams which are effective against either combusting non-polar flammable liquids or combusting water-miscible non-aqueous flammable solvents.

Hydrocarbon surfactants (that is to say surfactants having a hydrocarbon hydrophobic group) are common constituents of fire fighting foaming compositions. Whilst they may be included together with a partially acetylated polyvinyl alcohol in fire fighting foaming compositions, the compositions preferably do not include any hydrocarbon surfactant. The inclusion of a hydrocarbon surfactant may undesirably reduce foaming activity of foaming compositions containing a partially acetylated polyvinyl alcohol. This is believed to be because of the enhanced surface activity of hydrocarbon surfactants which preferentially adsorb at the liquid/air interface compared to the less mobile partially acetylated polyvinyl alcohol molecules.

Fire fighting foaming compositions containing a partially acetylated polyvinyl alcohol are preferably buffered below pH 7.0 at a slightly acidic pH. The preferred pH range is from 5.8 to 6.2. Maintaining the fire fighting foaming compositions at slightly acidic pH values helps to reduce or prevent additional hydrolysis (i.e. the conversion of units of formula (I) to units of formula (II)) of the polyvinyl alcohol during storage. Such additional hydrolysis may render the polyvinyl alcohol less suitable by causing a reduction in surface activity and a reduction in effectiveness of the composition for fighting fires. The preferred buffer for maintaining a slightly acidic pH is a buffer based on an acetic acid/acetate salt buffer couple, such as acetic acid/sodium acetate.

The following examples illustrate fire fighting foaming compositions containing partially acetylated polyvinyl alcohol in accordance with the invention. These examples are not limiting.

EXAMPLE 1

First and second fire fighting foaming compositions were made up from a 10% w/w solution of partially acetylated polyvinyl alcohol in water and the water miscible solvent butyl carbitol as shown in Table 1. The partially acetylated polyvinyl alcohol used in this Example was Gohsenol KH-20™ which is 78.5%-81.5% hydrolysed (i.e. the amount of the unit of formula (II) as a molar percentage of the combined amount of the units of Formulae (I) and (II) is 78.5%-81.5%). The molecular weight is approximately 150000. As shown in Table 1, Composition 2 also contained the hydrocarbon surfactant sodium decyl sulphate.

TABLE 1

| | Composition 1 | Composition 2 |
|---|---|---|
| 10% $^{w}/_{w}$ Gohsenol KH-20 ™ aqueous solution | 90 parts | 89 parts |
| Butyl Carbitol | 10 parts | 10 parts |
| Sodium Decyl Sulphate (30% actives) | — | 1 part |

Compositions 1 and 2 were each diluted to 6% v/v solutions in water, and the diluted solutions were used to form respective aerated foam samples using a branchpipe following the procedure of UK Defence Standard 42-40.

Each aerated foam sample was collected in a 1400 ml drainage pan according to NFPA 11. The expansion ratio and quarter drainage time (QDT) were measured. The expansion ratio is the ratio of the volume of the drainage pan to that of the volume of the 6% v/v diluted solution of the foaming composition that is required to generate the expanded foam sample needed to fill the drainage pan. The quarter drainage time is the time for 25% by volume of the foam solution to drain from the expanded foam sample. The results are shown in Table 2.

TABLE 2

| | Composition 1 | Composition 2 |
|---|---|---|
| Expansion Ratio | 6.2 | 4.5 |
| QDT (minutes) | 1.9 | 1.25 |

The results shown in Table 2 illustrate an undesirable reduction in both expansion ratio and QDT when the hydocarbon surfactant sodium decyl sulphate is added to the composition.

EXAMPLE 2

In this example, the ability of a fire fighting foaming composition (Composition 3), containing partially acetylated polyvinyl alcohol, to control and extinguish burning heptane (a non-polar solvent), was compared to that of several commercially available fire fighting foaming compositions. The compositions were aerated and applied as foams under strictly controlled conditions.

Composition 3 contained partially acetylated polyvinyl alcohol in the form of Gohsenol KH-20™ and a protein derived surfactant in the form of commercially available Polyhydrotorque™ (available from Kidde). Composition 3 comprised 6% $^{v}/_{v}$ of Polyhydrotorque™ solution as supplied by the manufacturer and 6% $^{v}/_{v}$ of a 5% $^{w}/_{w}$ aqueous solution of Gohsenol KH-20™. The balance of Composition 3 was fresh water. The composition was used without further dilution.

The comparative, commercially available foaming compositions consisted of a fluoroprotein containing foaming composition sold under the name FP70™ by Kidde and two fluorine-free foaming compositions sold as Syndura™ (manufactured by Kidde) and RF6™ (manufacted by 3M Australia). Syndura™ and RF6™ were used as 6% solutions in water whereas FP70™ was used as a 3% solution in water.

Each foaming composition was tested according to the informative protocol outlined in EN1568 Part 3 at an application rate of 3 litres/minute/$m^2$ on a circular pan containing burning heptane. The results are shown in Table 3.

TABLE 3

| | 90% Control | Extinguishment | Burnback |
|---|---|---|---|
| Composition 3 | 31 s | 53 s | 9.1 mins |
| FP70 ™ | 34 s | 56 s | 13.1 mins |
| Syndura ™ | 29 s | Not achieved | 9.7 min |
| RF6 ™ | 46 s | 157 s | 11.0 mins |

Table 3 demonstrates that Composition 3 containing partially acetylated polyvinyl alcohol extinguished the burning heptane faster than the fluorine free compositions Syndura™ and RF6™, and had a similar extinguishing performance to the fluoroprotein containing composition FP70™. Composition 3 demonstrated a similar fire control capability as compared to FP70™ and Syndura™ and a better control capability as compared to RF6™. Burnback time was broadly comparable with that of the commercially available compositions.

EXAMPLE 3

A fire fighting foaming composition (Composition 4) containing a partially acetylated polyvinyl alcohol, a protein derived surfactant, a water miscible solvent and a buffer was made by mixing materials set out in Table 4.

TABLE 4

| Composition 4 | Parts |
|---|---|
| 10% $^{w}$/w aqueous solution of partially acetylated polyvinyl alcohol (Gohsenol KH-20 ™) | 60 |
| Protein liquor of refractive index 1.400 into which is dissolved 23 g per litre of sodium acetate | 40 |
| Hexylene glycol | 10 |

The sodium acetate forms a buffer which maintains the composition at a slightly acidic pH. In view of this, Composition 4 may be stored for a significant length of time before being diluted for use. The preferred dilution ratio is 6 parts to 94 parts of water and Composition 4 was used at this dilution in the tests described below-fresh water being used as the diluent.

Composition 4 was tested according to the protocol outlined in UK Defence Standard 42-40 at an application rate of 3 litres/minute/m$^2$ on both aviation gasoline (Avgas 100LL) and aviation kerosene (Avtur) fires. FP70™, Syndura™ and RF6™ were used as comparative compositions and diluted as set out in Example 2 above. The results are set out in Tables 5 and 6 below.

TABLE 5

| Avtur Test Results | | | |
|---|---|---|---|
| | 90% Control | Extinguishment | Burnback |
| Composition 4 | 33 s | 46 s | 11.3 mins |
| FP70 | 31 s | 63 s | 22.3 mins |
| Syndura | 26 s | 81 s | 14 mins |
| RF6 | 40 s | 143 s | 12.7 mins |

As shown in Table 5, Composition 4 exhibited comparable fire control and faster fire extinction compared to the commercially available compositions. The burnback time for Composition 4 was comparable to that for Syndura™ and RF6™ but shorter than that for the fluoroprotein composition FP70™.

TABLE 6

| Avgas Test Results | | | |
|---|---|---|---|
| | 90% Control | Extinguishment | Burnback |
| Composition 4 | 46 s | 58 s | 10.5 mins |
| FP70 | 41 s | 48 s | 13.2 mins |
| Syndura | 29 s | 205 s | 13 mins |
| RF6 | 80 s | 225 s | 15.6 mins |

As shown in Table 6, Composition 4 exhibited a faster fire extinction time compared to the fluorine free commercially available compositions Syndura™ and RF6™ and a comparable extinction time to FP70™. The burnback time for Composition 4 was comparable to that of the commercially available compositions.

With regard to the second aspect of the invention, chitosan is a cationic polymer. More specifically, it is a linear polysaccharide comprising D-glucosamine units. It may also contain N-acetyl-D-glucosamine units. Chitosan is commonly formed by partial or total deacetylation of chitin, which is found in the exoskeleton of crustaceans.

It has now been found that chitosan enhances the production of foam when included in a fire fighting foaming composition with a surfactant.

Chitosan is available commercially. For example it is sold under the name Kytamer PC™ by Amerchol Corporation.

Chitosan is conveniently used in formulating the fire fighting foaming compositions as a 5% $^{w}$/v solution in a liquid consisting of a mixture of a polar organic solvent and water. The polar organic solvent may be, for example, butyl carbitol or hexylene glycol and may, for example, represent 10-20% by volume of the liquid. The polar organic solvent is used to 'wet' the polymer to aid its incorporation into the aqueous phase. It also acts beneficially to improve the foaming characteristics of the final fire fighting foaming composition.

One type of suitable surfactant that may be used in the fire fighting foaming composition of the second aspect of the invention is a protein derived surfactant. For example, the surfactant may be derived from the alkali hydrolysis of a keratin containing feedstock, such as hoof and horn meal or feather meal. More specifically, a protein liquor of refractive index 1.417, derived from alkali hydrolysis of a keratin containing feedstock, is a suitable surfactant for the fire fighting foaming composition.

As discussed above, a preferred form of fire fighting foaming composition comprises a liquid, which may be, for example, water or water with a water miscible non-aqueous solvent, and one or more components each of which may be in solution or dispersed in the liquid, so that the composition as a whole is generally fluid in nature. The 5% w/v chitosan solution discussed above and the protein liquor discussed above are particularly convenient for formulating such a foaming composition. For example, such a foaming composition may contain from 50% to 70% (v/v) of the 5% chitosan solution. The foaming composition may contain, for example, up to 30% (v/v), and more preferably 15% to 20% (v/v) of the protein liquor. In addition, the foaming composition may contain up to 5% (v/v), and more preferably, 2% to 3% (v/v), of a polar solvent, such as hexylene glycol, butyl carbitol or polyethylene glycol (this is in addition to the polar solvent contained in the chitosan solution). The polar solvent further enhances the foaming characteristics. The balance of the foaming composition (if any) is water.

Chitosan forms acidic solutions. However, the fire fighting foaming composition is preferably buffered at a pH below 6.5. This aids stability during long term storage of the fire fighting foaming composition. The preferred pH range is 5.5 to 6.0 and the preferred buffer comprises acetic acid and an acetate salt such as sodium acetate.

The concentrations given above produce a foaming composition which foams most effectively when diluted at 6 parts foaming composition to 94 parts water.

Instead of a protein derived surfactant, it is possible to use a surfactant having a hydrocarbon hydrophobic group (termed a hydrocarbon surfactant). Suitable hydrocarbon surfactants are non-ionic hydrocarbon surfactants and amphoteric hydrocarbon surfactants. Examples of suitable amphoteric hydrocarbon surfactants are Tegobetaine F50™ (made by Goldschmidt) and Empigen OS/A™ (made by Huntsman). An example of a suitable non-ionic hydrocarbon surfactant is APG325N™ (made by Cognis).

Anionic hydrocarbon surfactants are not suitable as they produce a precipitate when mixed with the chitosan.

While the current aspect of the invention is not limited to any theory underlying the mechanism by which chitosan enhances foam performance, one possible mechanism is that precipitation of chitosan in the already formed foam stabilises the foam. Below pH 6.5 chitosan is protonated. As the pH rises above 6.5, the functional amine groups are de-protonated and chitosan undergoes interpolymer association and precipitation. One possible mechanism of action is that as the fire fighting foaming composition is diluted and aerated to form a foam, the pH rises and the chitosan precipitates in the bubble walls of the foam, thereby stabilising the foam.

The chitosan containing foaming compositions of the second aspect of the invention are preferably free of fluorine containing surfactants and more preferably free of any fluorine containing constituent.

The following Examples illustrate the second aspect of the invention, without limiting the scope of the invention.

EXAMPLE 4

A foaming composition for dilution at 6 parts in 94 parts of water was prepared from the following constituents.

| | |
|---|---|
| Protein Derived Surfactant - protein liquor of refractive index 1.417 (as discussed above) | 18% $^{v}/v$ |
| Sodium acetate (anhydrous) | 2% $^{w}/v$ |
| Glacial acetic acid | 0.35 $^{v}/v$ |
| 5% $^{w}/v$ chitosan solution (as discussed above) | 66% $^{v}/v$ |
| Hexylene glycol | 3% $^{v}/v$ |
| Water | Balance |

A sample of the foaming composition was whisked in a Sunbeam Mixmaster kitchen blender on the maximum speed setting for 2 minutes. A volume of unleaded petrol amounting to 20% $^{v}/v$ of the foaming solution was added to the aerated foam in the blender bowl, and whisked for a further 30 seconds. After standing for a further 30 seconds, a lighted taper was applied to the surface of the aerated foam. The time for the subsequent flaming to be controlled and then extinguished was noted.

For comparison purposes, two commercialised foaming compositions were tested under the same conditions. One was a fluorine-free composition based on protein derived surfactants, called Nicerol™ and made by Kidde. The other was FP70™ as discussed above. Nicerol was diluted for use at 6 parts in 94 parts water, whereas FP70 was diluted for use at 3 parts in 97 parts water. The results are shown in Table 7.

TABLE 7

| | Control | Extinguishment |
|---|---|---|
| Chitosan based foaming compound | 1 s | 77 s |
| Nicerol | Did not control | Did not extinguish and burned to destruction |
| FP70 | 12 s | 56 s |

From this test, it is apparent that the fire fighting foaming composition containing chitosan resists contamination by petrol and is able to control and self-extinguish much in the same way as the fluoroprotein foam FP70™.

EXAMPLE 5

A foaming composition for dilution at 3 parts in 97 parts of water was prepared from the following constituents:

| | |
|---|---|
| 1) Protein Derived Surfactant Protein liquor of refractive index 1.420 (as discussed above) | 35 parts by volume |
| 2) Sodium acetate (anhydrous) | 2 parts by weight |
| 3) Glacial acetic acid | 0.35 parts by volume |
| 4) 5% $^{w}/v$ Chitosan solution (as discussed above) | 62 parts by volume |
| 5) Hexylene glycol | 3 parts by volume |
| 6) Ground Chitosan (Kytamer PC ™ powder) | 3.5 parts by weight |

Items 1-5 were stirred together until a homogeneous mix resulted. Then Item 6 was slowly added and stirred until all had been incorporated. The foaming composition was then transferred to an oven at 60° C., and stored for 5 days. This allowed the secondary addition of chitosan powder to become fully hydrated, so that a mobile, homogeneous composition was formed.

This was tested in the same manner as the foaming composition described in Example 4. The composition was first diluted at 3 parts composition to 97 parts water. The results are shown in Table 8.

TABLE 8

| | Control | Extinguishment |
|---|---|---|
| Chitosan based foaming compound | 7 s | 14 s |

The result demonstrates that the chitosan foaming composition for use at 3 parts in 97 parts water, behaves in the same manner as the fluoroprotein foam under these test conditions.

EXAMPLE 6

The foaming composition of Example 5 was tested according to the protocol outlined in UK Defence Standard 42-40 at an application rate of 3 litres/minute/$m^2$ on an aviation gasoline (Avgas 100LL) fire, the composition being diluted in fresh water. Syndura™ and RF6™ were used as comparative compositions and diluted as set out in Example 2 above. The results are set out in Table 9 below.

TABLE 9

| Avgas Test Results | | | |
|---|---|---|---|
| | 90% Control | Extinguishment | Burnback |
| Chitosan composition | 54 s | 88 s | 11.5 mins |
| Syndura | 29 s | 205 s | 13 mins |
| RF6 | 80 s | 225 s | 15.6 mins |

As shown in Table 9, the chitosan composition exhibited a faster fire extinction time compared to the fluorine free commercially available compositions Syndura™ and RF6™ and the burnback time was comparable.

The invention claimed is:

1. A fire fighting foaming composition or a fire fighting foam comprising:

a partially acetylated polyvinyl alcohol comprising units of formula (I) and units of formula (II), wherein in the partially acetylated polyvinyl alcohol, the units of formula (II) make up from 71 to 89% on a molar basis of the combined amount of units of formulae (I) and (II)

(I)

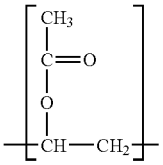

(II)

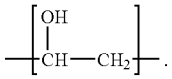

2. A fire fighting foaming composition or a fire fighting foam according to claim 1, wherein in the partially acetylated polyvinyl alcohol, the units of formula (II) make up from 78.5 to 83.5% on a molar basis of the combined amount of units of formulae (I) and (II).

3. A fire fighting foaming composition or a fire fighting foam according to claim 1, wherein the partially acetylated polyvinyl alcohol has a molecular weight from 30,000 to 185,000.

4. A fire fighting foaming composition or a fire fighting foam according to claim 3, wherein the partially acetylated polyvinyl alcohol has a molecular weight from 125,000 to 185,000.

5. A fire fighting foaming composition or a fire fighting foam according to claim 1, wherein the composition or foam also contains a protein derived surfactant.

6. A fire fighting foaming composition or a fire fighting foam according to claim 5, wherein the protein derived surfactant is made by alkali hydrolysis of a keratin containing feedstock.

7. A fire fighting foaming composition or a fire fighting foam according to claim 1, wherein the composition or foam does not contain any fluorine containing surfactant.

8. A fire fighting foaming composition or a fire fighting foam according to claim 7, wherein the composition or foam does not contain any fluorine containing component.

9. A fire fighting foaming composition or a fire fighting foam according to claim 1, wherein the composition or foam does not contain any hydrocarbon surfactant.

10. A fire fighting foaming composition according to claim 1, wherein the composition includes a liquid comprising at least water, and the partially acetylated polyvinyl alcohol is dissolved and/or dispersed in the liquid.

11. A fire fighting foaming composition according to claim 10, wherein the composition is buffered and the pH of the composition is below 7.0.

12. A fire fighting foaming composition according to claim 11, wherein the pH of the composition is from 5.8 to 6.2.

13. A fire fighting foaming composition according to claim 11, wherein the composition comprises acetic acid and an acetate salt which act to buffer the composition at said pH.

14. A fire fighting foaming composition according to claim 10, wherein the liquid also contains a water miscible non-aqueous solvent.

15. A fire fighting foaming composition according to claim 14, wherein the water miscible non-aqueous solvent is selected from the group consisting of glycols and glycol ethers.

16. A fire fighting foaming composition according to claim 14, wherein the water miscible non-aqueous solvent is selected from the group consisting of: hexylene glycol; butyl carbitol; butyl cellosolve; polyethylene glycol; methyl diproxitol; propylene glycol n-propyl ether; and tripropylene glycol methyl ether.

17. A fire fighting foaming composition or a fire fighting foam comprising:

a linear polysacharide comprising D-glucosamine units and, optionally N-acetyl-Dglucosamine units; and a surfactant, but excluding the case wherein the surfactant has a hydrocarbon hydrophobic region, an anionic hydrophilic region and no cationic hydrophilic region.

18. A fire fighting foaming composition or a fire fighting foam comprising:

a poly-D-glucosamine; and a surfactant, but excluding the case wherein the surfactant has a hydrocarbon hydrophobic region, an anionic hydrophilic region and no cationic hydrophilic region.

19. A fire fighting foaming composition or a fire fighting foam according to claim 17, wherein the polysacharide is chitosan or a salt of chitosan.

20. A fire fighting foaming composition or a fire fighting foam according to claim 17, wherein the surfactant is a protein derived surfactant.

21. A fire fighting foaming composition or a fire fighting foam according to claim 20, wherein the protein derived surfactant is derived from the alkali hydrolysis of a keratin containing feedstock.

22. A fire fighting foaming composition or a fire fighting foam according to claim 17, wherein the surfactant has a hydrocarbon hydrophobic region and the surfactant is either non-ionic or amphoteric.

23. A fire fighting foaming composition according to claim 17, wherein the composition includes a liquid comprising at least water, and the polysacharide or the poly-D-glucosamine and the surfactant are dissolved and/or dispersed in the liquid.

24. A fire fighting foaming composition according to claim 23, wherein the composition is buffered and the pH of the composition is below 6.5.

25. A fire fighting foaming composition according to claim 24, wherein the pH of the composition is from 5.5 to 6.0.

26. A fire fighting foaming composition according to claim 24, wherein the composition comprises acetic acid and an acetate salt which act to buffer the composition at said pH.

27. A fire fighting foaming composition according to claim 23, wherein the liquid also contains a water miscible organic solvent.

28. A fire fighting foaming composition according to claim 27, wherein the water miscible organic solvent is selected from the group consisting of: hexylene glycol; butyl carbitol; and polyethylene glycol.

29. A fire fighting foaming composition or a fire fighting foam according to claim 17, wherein the composition or foam does not contain any fluorine containing surfactant.

30. A fire fighting foaming composition or a fire fighting foam according to claim 29, wherein the composition or foam does not contain any fluorine containing component.

31. A method of extinguishing or controlling a fire comprising, forming a foam from the fire fighting foaming composition of claim 17, and applying the foam to the fire.

32. A method of extinguishing or controlling a fire according to claim 31, wherein the fire comprises a burning liquid.

33. A method of extinguishing or controlling a fire according to claim 32, wherein the burning liquid is a water-miscible solvent.

34. A method of extinguishing or controlling a fire according to claim 32, wherein applying the foam to the fire comprises distributing the foam over the burning liquid to form a foam layer.

35. A method of extinguishing or controlling a fire according claim 31 wherein forming the foam includes dilution of the fire fighting foaming composition, the pH in the foam is greater than 6.5, and the foam contains precipitated chitosan.

* * * * *